US011597116B1

(12) United States Patent
Kent et al.

(10) Patent No.: US 11,597,116 B1
(45) Date of Patent: Mar. 7, 2023

(54) VERTICAL SLICER

(71) Applicant: Progressive International Corporation, Kent, WA (US)

(72) Inventors: Joseph Kent, Seattle, WA (US); Geoff Woo, Seattle, WA (US)

(73) Assignee: Progressive International Corp., Kent, WA (US)

( * ) Notice: Subject to any disclaimer, the term of this patent is extended or adjusted under 35 U.S.C. 154(b) by 0 days.

(21) Appl. No.: 17/475,253

(22) Filed: Sep. 14, 2021

(51) Int. Cl.

| | |
|---|---|
| ***B26D 7/22*** | (2006.01) |
| ***B26D 3/28*** | (2006.01) |
| ***B26D 7/06*** | (2006.01) |
| ***B26D 7/26*** | (2006.01) |
| ***B26D 7/00*** | (2006.01) |

(52) U.S. Cl.
CPC ..... *B26D 7/225* (2013.01); *B26D 3/283* (2013.01); *B26D 7/0641* (2013.01); *B26D 7/2628* (2013.01); *B26D 2003/287* (2013.01); *B26D 2003/288* (2013.01); *B26D 2007/0018* (2013.01); *B26D 2210/02* (2013.01)

(58) Field of Classification Search
CPC .... B26D 3/26; B26D 3/283; B26D 2003/285; B26D 2003/286; B26D 2003/287; B26D 2003/288; B26D 2210/02; B26D 5/10; B26D 1/04; B26D 1/06; B26D 1/08; B26D 1/09; B26D 7/0641; B26D 2007/0018; B26D 7/225; A47J 43/25
See application file for complete search history.

(56) References Cited

U.S. PATENT DOCUMENTS

| | | | | | |
|---|---|---|---|---|---|
| 489,647 | A | * | 1/1893 | Coe | B26D 3/26 30/303 |
| 1,358,020 | A | * | 11/1920 | Rosinsky | B26D 3/18 83/717 |
| 1,421,458 | A | * | 7/1922 | Wright | B26D 3/26 30/305 |
| 1,755,446 | A | * | 4/1930 | Jackman | A47J 43/25 83/401 |
| 1,971,657 | A | | 4/1932 | Quam | |
| 2,130,755 | A | | 4/1936 | Gednetz | |
| 2,103,537 | A | * | 12/1937 | Killman | B26D 3/283 83/123 |
| 2,487,371 | A | | 11/1949 | Quam | |
| 2,625,972 | A | * | 1/1953 | Torres | B26D 3/26 99/545 |
| 2,782,826 | A | * | 2/1957 | Zysset | B26D 3/26 83/556 |
| 3,101,758 | A | | 8/1963 | Carroll | |

(Continued)

FOREIGN PATENT DOCUMENTS

DE 20 2016 106 708 * 4/2018

*Primary Examiner* — Evan H Macfarlane
(74) *Attorney, Agent, or Firm* — Lowe Graham Jones PLLC

(57) ABSTRACT

A vertical slicer includes a frame having a cover plate with a central opening and a hopper positioned over the opening. A carriage having a deck and a main cutting blade is attached to a spring-loaded plunger for reciprocating vertical movement within the frame. A tray collects food items cut by the main blade, which can be selectively adjusted to change a slicing thickness. A locking switch is configured to lock the plunger and carriage in a lowered locked position.

13 Claims, 17 Drawing Sheets

(56) References Cited

U.S. PATENT DOCUMENTS

| | | | | |
|---|---|---|---|---|
| 3,112,781 | A * | 12/1963 | Popeil | B26D 3/185 83/425.2 |
| 4,967,970 | A * | 11/1990 | Michel | B26D 3/26 241/169 |
| 5,421,249 | A * | 6/1995 | Repisky | A23N 4/00 99/545 |
| 7,543,768 | B2 | 6/2009 | Cohen et al. | |
| 10,220,536 | B2 | 3/2019 | Bernede | |
| 11,433,564 | B1 * | 9/2022 | Chen | B26D 3/283 |
| 2001/0028007 | A1 * | 10/2001 | Michel | B26D 3/26 241/169 |
| 2010/0180778 | A1 | 7/2010 | Walker et al. | |
| 2017/0190066 | A1 * | 7/2017 | Fastabend | B26D 3/26 |
| 2019/0255723 | A1 * | 8/2019 | Chan | B26D 7/01 |
| 2020/0047368 | A1 * | 2/2020 | Jin | B26D 1/06 |
| 2020/0276725 | A1 * | 9/2020 | Hauser | B26D 7/2628 |
| 2021/0187774 | A1 * | 6/2021 | Markiewicz | B26D 7/2614 |

* cited by examiner

VERTICAL SLICER

BACKGROUND OF THE INVENTION

A hand-operated mandoline slicer is a popular tool for quickly slicing vegetables into evenly cut slices. In many cases, they allow for julienne slicing or cubing quickly and easily. One problem with a mandoline slicer is that users may operate them without using the safety hand guard. The hand guard will prevent a user from cutting his or her hand, but without the hand guard a cut may happen quite easily. Despite the risk, many users prefer not to use the hand guard. Other users are afraid of the possibility of a cut, and for that reason they simply avoid them.

There are some efforts to produce a safer version of a mandoline slicer, such as in US patent application publication 2020/0047368 to Jin. The Jin device employs a carriage having a blade, in which the carriage can move up and down within a housing. The housing has a hopper covering an access opening to the blade, making it very difficult for a user to get a finger close to the blade. While this may offer an improvement in some respects, various shortcomings remain.

SUMMARY OF THE INVENTION

A preferred vertical slicer includes a frame having a lower end and an upper end, the lower end terminating in a foot, the frame having a pair of opposing frame sidewalls. A face plate covers a front side of the frame and extends across the opposing sidewalls, the face plate further extends from the lower end to the upper end of the frame, and has a central opening.

A carriage having an upper end, a lower end, and opposing carriage sidewalls extending from the upper end to the lower end of the carriage includes a deck pivotally attached to the lower end of the carriage. A main blade is attached to the carriage adjacent the deck and extends between the opposing carriage sidewalls. A plunger having a plunger cap is fixedly attached to the upper end of the carriage. The carriage further has a pair of guide bars extending laterally outwardly from the opposing carriage sidewalls.

The frame further has a pair of carriage guide slots formed in the pair of opposing frame sidewalls, one of the pair of guide bars being received in a corresponding one of the pair of carriage guide slots, wherein the pair of carriage guide slots define a path of travel of the carriage with respect to the frame, the carriage being positioned rearward of the face plate.

A plunger guide is mounted to the upper end of the frame, the plunger guide having a crossbar. The plunger further has a plunger slot extending diametrically through the plunger, the crossbar being trained within the plunger slot and further defining a path of travel of the plunger.

A plunger spring is positioned in an interior space within the plunger, the plunger spring being mounted to urge the plunger and the carriage toward an upward position in which the plunger cap is moved away from the frame.

A locking switch is mounted on an axle positioned on the plunger guide, the locking switch being pivotally moveable between a locked position and an unlocked position, the locking switch having a tab extending toward the plunger, the plunger further having a locking cavity formed in an upper end of the plunger, wherein when the plunger is moved to a downward position and the locking switch is moved to the locked position, the tab is received within the locking cavity to retain the plunger and the carriage in the downward position.

In some versions, a pair of legs is provided, each of the legs being pivotally attached to the frame.

In some versions, a tray is attached to the frame via a tray pin, the tray pin extending between the opposing frame sidewalls.

In some versions, the tray pin further comprises a pair of spacers and the pair of cutouts, the cutouts being sized and positioned to receive the pair of cutouts.

In some versions, the plunger spring is seated on the crossbar.

In some versions, the slicer includes a hopper attached to the frame, the hopper surrounding the central opening of the face plate.

In some versions, the plunger guide further includes an abutment, the abutment being positioned to frictionally hold the locking switch in either the locked position or the unlocked position.

In some versions, the plunger guide further includes an upper plate and a lower plate, the abutment being formed on the lower plate.

In some versions, the axle extends between the upper plate and the lower plate.

In some versions, the slicer has a pair of legs terminating in a leg crossbar joining the pair of legs, each of the pair of legs being pivotally attached to the frame, the pair of legs each further having an upper rib and a lower rib, the upper rib and the lower rib each being positioned adjacent the leg crossbar.

In some versions, the tray further includes a pair of opposing tray pins extending laterally outwardly, each of the opposing tray pins being received in a space defined between the upper rib and the lower rib of the pair of legs.

In some versions, the slicer includes a pair of leg retainers, the pair of legs being pivotally attached to the frame via the pair of leg retainers, the leg retainers further having a pair of cavities sized and configured to receive a respective one of the pair of opposing tray pins when the tray is pivoted to an upward storage position.

In some versions, the carriage further has a crossmember extending between the opposing carriage sidewalls, a thickness bar further extending between the opposing carriage sidewalls and being pivotally moveable by a knob, the thickness bar being in contact with the deck.

BRIEF DESCRIPTION OF THE DRAWINGS

The preferred embodiments of the invention are described below with reference to the following drawings.

DETAILED DESCRIPTION OF THE PREFERRED EMBODIMENT

Figure 1:
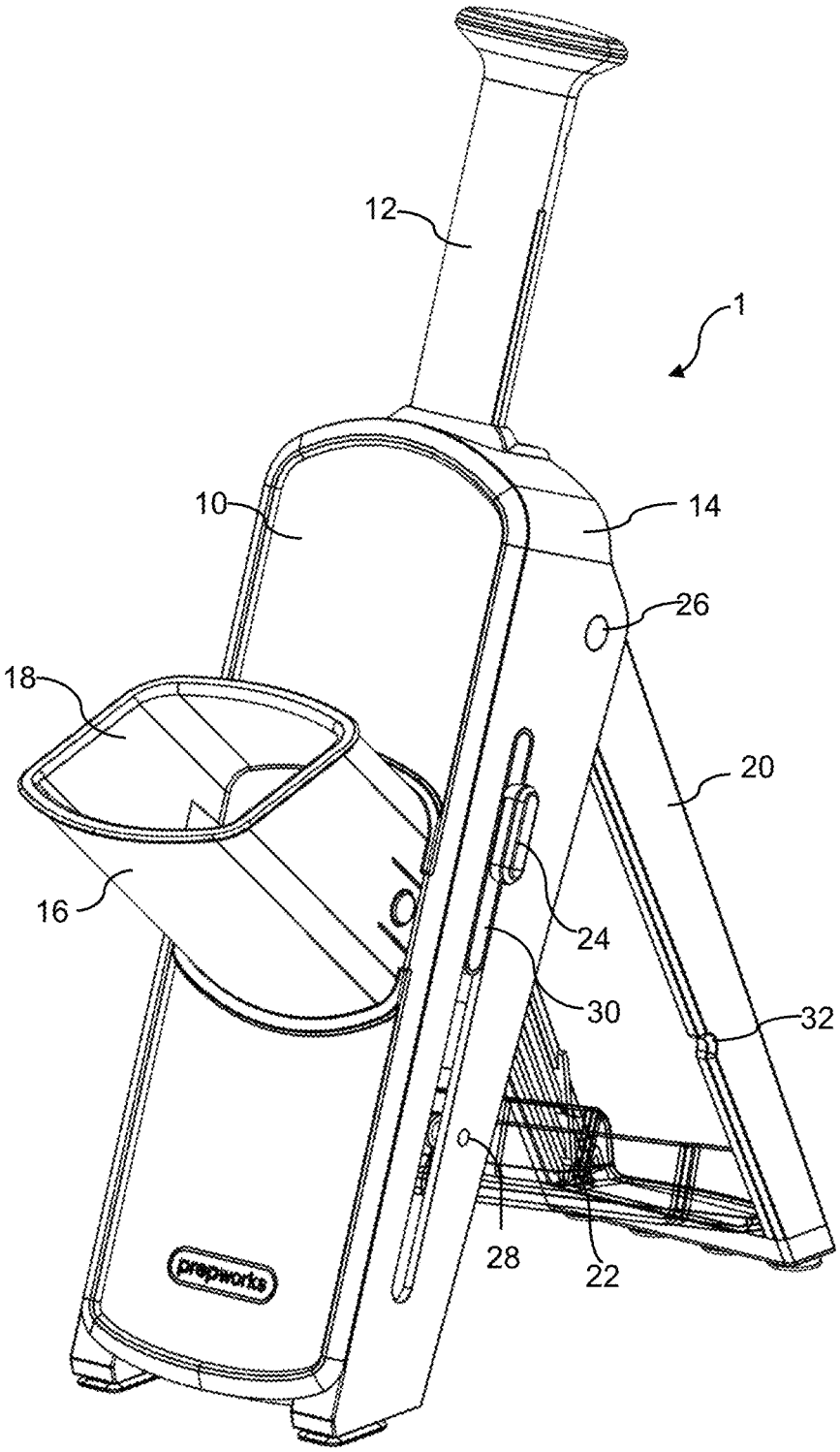
FIG. 1 is a front perspective view of a preferred vertical slicer.

A preferred version of a vertical slicer 1 is shown in the accompanying figures. FIG. 1 illustrates the slicer in a top perspective view, in which the slicer 1 includes a frame 14 supporting a plunger 12. One or more legs 20 is pivotally attached to the frame 14 at a pivot location 26 for movement between a deployed position as illustrated and a stowed position in which the legs are moved within the frame. A face plate 10 is provided at a front side of the slicer, preventing user access to the moving blades behind the face plate. A hopper 16 is mounted to the frame at a central location, and receives a pusher 18 to push food into the hopper and toward a blade. A carriage (not visible in FIG. 1) moves up and down within the housing, guided by a pair of guide bars (e.g., 30). A tray 22 is positioned at the back side of the slicer to catch food sliced by a main blade (not visible). The tray is supported by bar attached to the mainframe at an attachment location 28.

Figure 2:
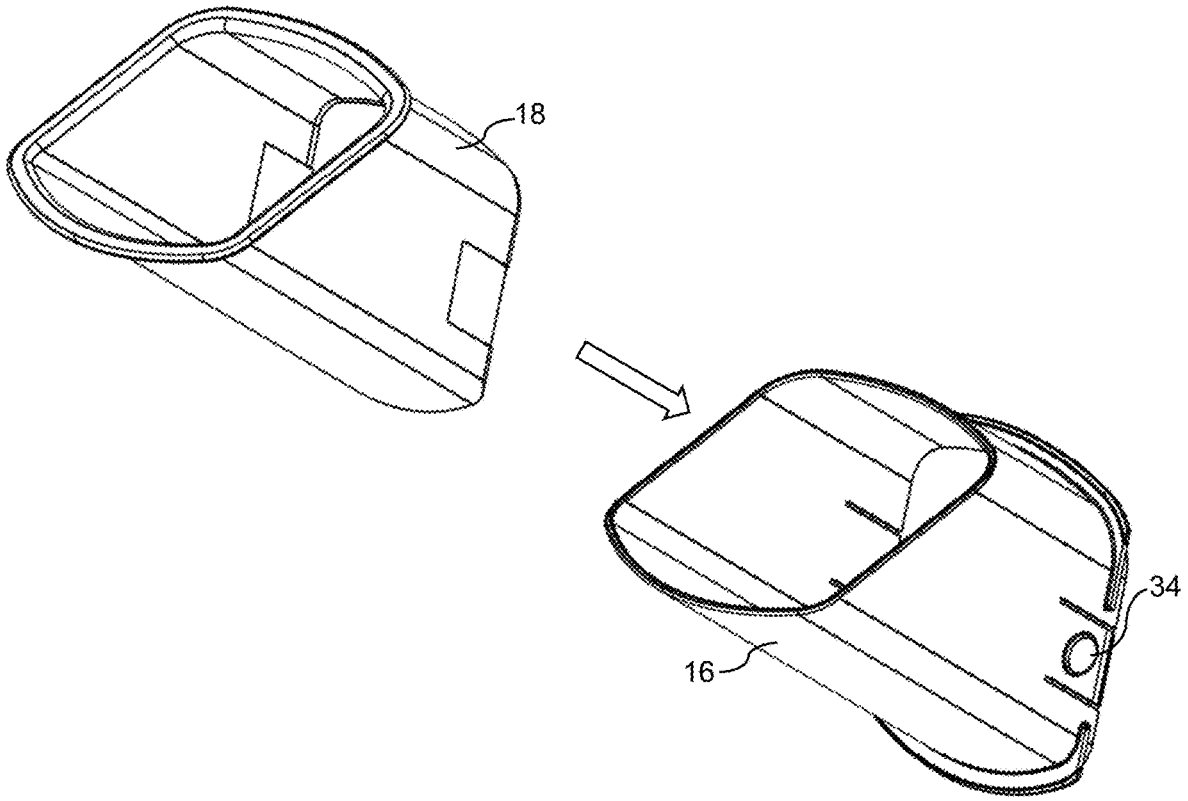
FIG. 2 is a front perspective view of a preferred hopper and plunger, shown separated from the vertical slicer.

FIG. 2 is an exploded view of a hopper 16 shown separated from the frame 14*m* with a pusher 18 illustrated as being moveable in a direction toward the hopper. The hopper preferably is removably attachable to the frame by one or more locking tabs 34 integrally formed in the hopper with a living hinge or otherwise having a flexible connection allowing a user to squeeze the hopper to remove it from the frame.

Figure 3:
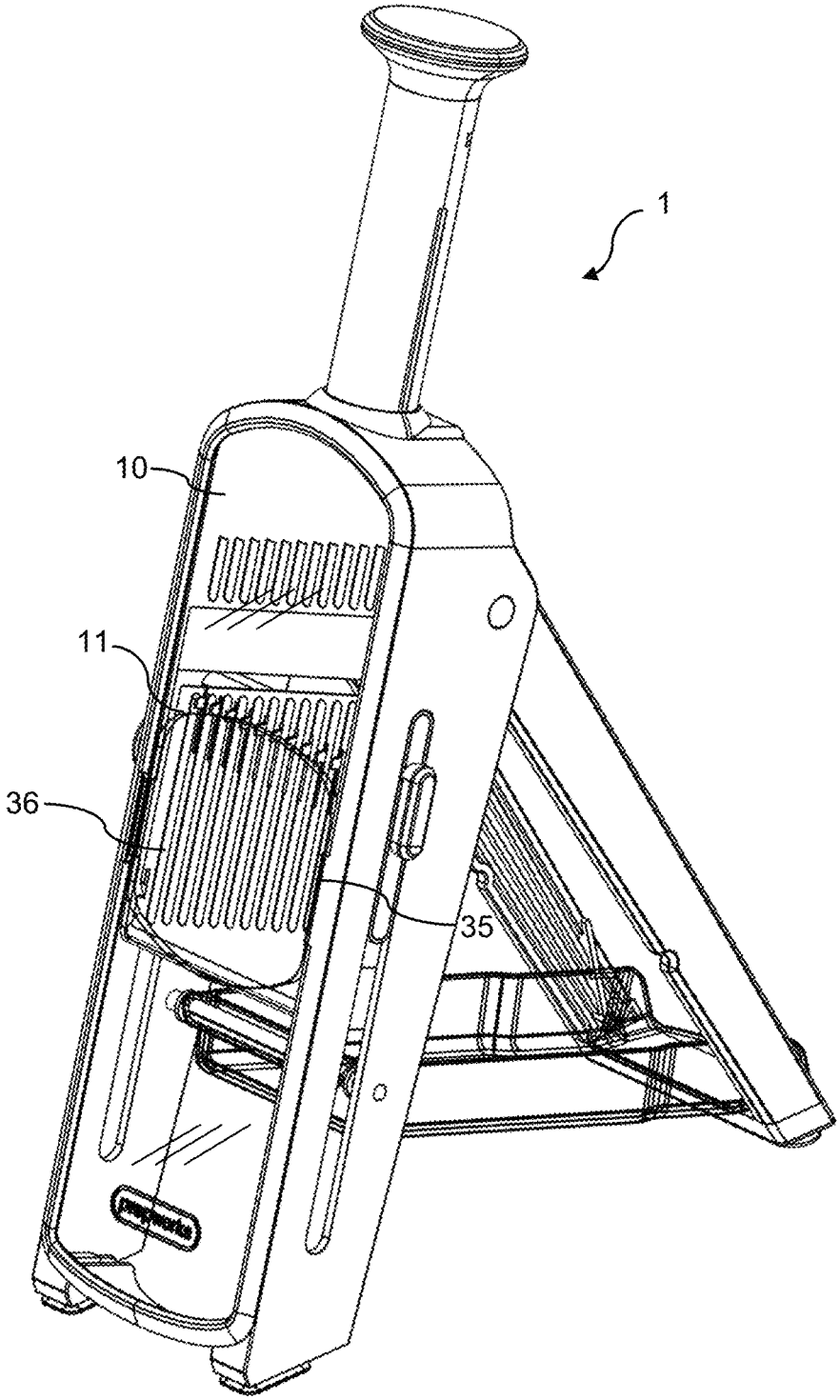
FIG. 3 is a front perspective view of a preferred vertical slicer, shown with the hopper and plunger removed and a face plate illustrated as being transparent in order to show features behind the face plate.

FIG. 3 shows the preferred vertical slicer 1 with the hopper removed and the face plate shown as being transparent to see more of the carriage behind it. The face plate 10 includes a central opening 11 formed with a perimeter matching that of the hopper so that food may travel down the hopper and through the face plate to reach the main blade as described below. A deck 36 of the carriage is shown through the opening in FIG. 3.

Figure 4:
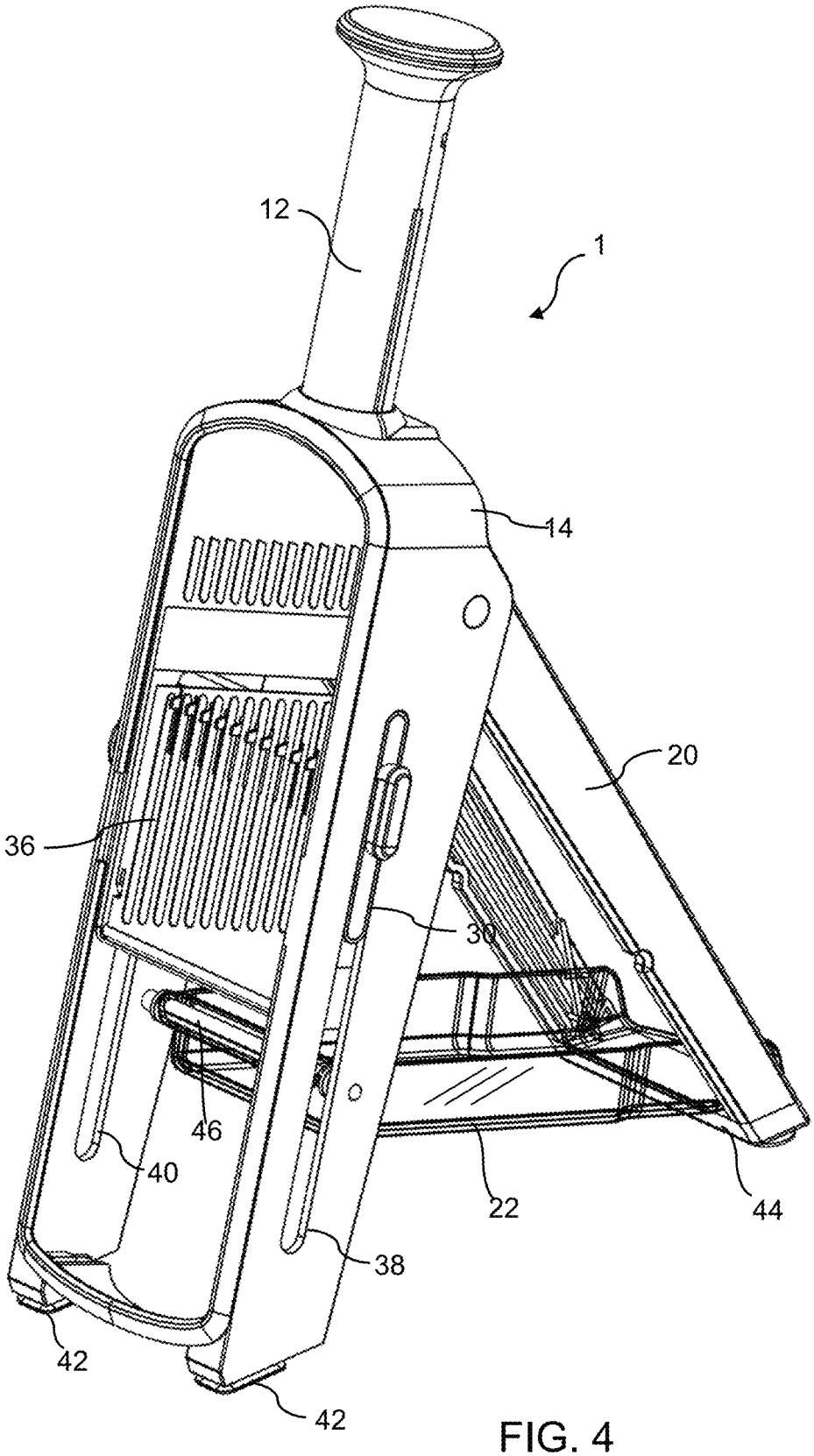
FIG. 4 is an illustration of the vertical slicer of FIG. 3, shown with the face plate removed.

FIG. 4 shows the vertical slicer 1 with the face plate removed. Additional features are also more readily visible. The frame 14 includes a pair of opposing slots 38, 40 at each side, and extending vertically between a lower end of the frame adjacent a pair of feet 42 and the upper end near the plunger 12. The carriage, as described further below, includes a pair of opposing guide bars (e.g., 30) positioned within one of the opposing slots 38, 40 to travel up and down within the slots. In the illustrated example, the guide bars are elongated and extend along a substantial portion of the length of the slots. In one version the guide bars are preferably at least 25 percent, or more preferably at least 33 percent, of the length of the slots.

The tray 22 is supported at one end by a tray pin 46. At the opposite end of the tray, the tray is supported between a pair of rear legs 20. The rear legs terminate in a leg crossbar 44 which joins them together.

Figure 5:
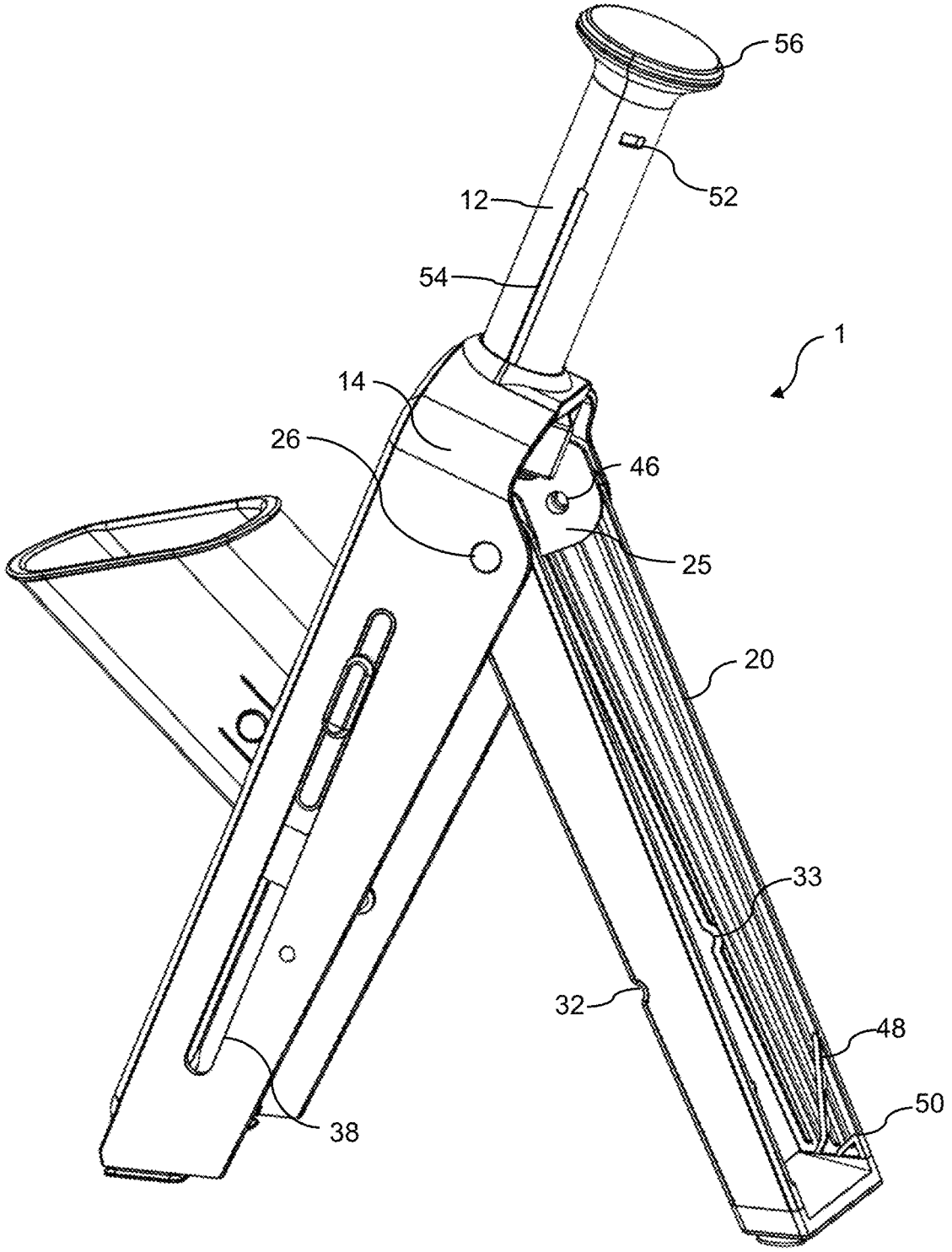
FIG. 5 is a right side view of a preferred vertical slicer.

FIG. 5 shows a side view of a preferred vertical slicer, with the tray removed. At a lower location on one of the legs 20, a pair of ribs including an inclined upper rib 48 and a lower rib 50 are provided. The ribs are configured to receive a corresponding pin on the tray, guiding the pin to the leg crossbar and retaining the tray in position between the legs. At the upper end of the frame, a pair of opposing cavities 46 is provided. Each of the opposing cavities is sized and positioned to receive one of the pins on the tray when the tray is rotated against the frame for a storage position.

FIG. 5 shows certain details of the plunger 12, including a plunger cap 56. The plunger cap is arranged to be received in the palm of the hand of a user, allowing the user to press the plunger downward, in the direction toward the feet of the slicer. The plunger includes a pair of opposing slots (e.g., slot 54 which guide the plunger and restrain it against rotational movement as described below. A locking cavity 52 is formed in the plunger, to be used to retain the plunger in a locked position as described below.

Figure 6:
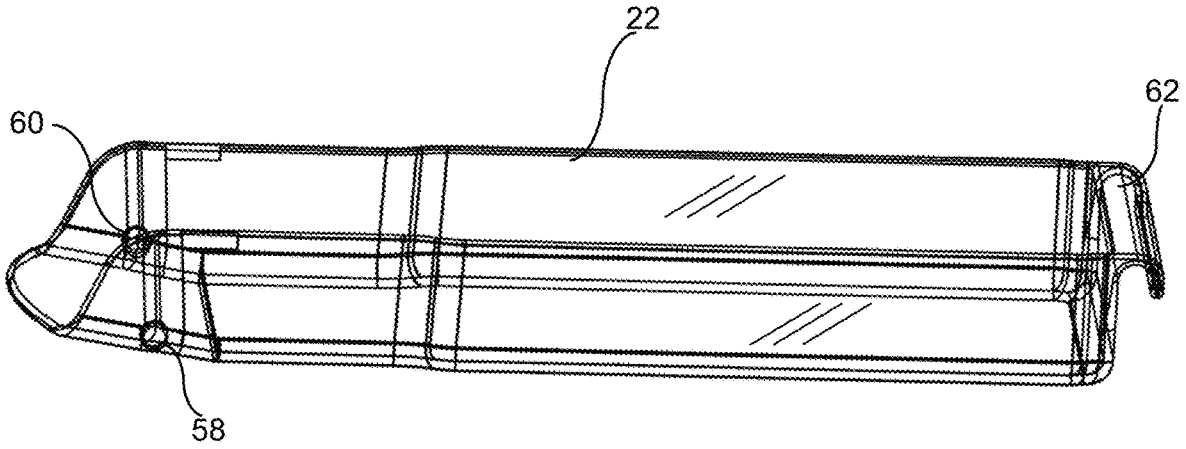
FIG. 6 is a right side view of a preferred tray for use with a vertical slicer.

FIG. 6 shows the tray 22 removed from the slicer. The pair of opposing pins 58, 60 are shown, and each side is visible because the tray is illustrated as being formed from a translucent material. At a rear end, a channel 62 is formed and is sized to receive the tray pin to support the tray by the tray pin.

Figure 7:
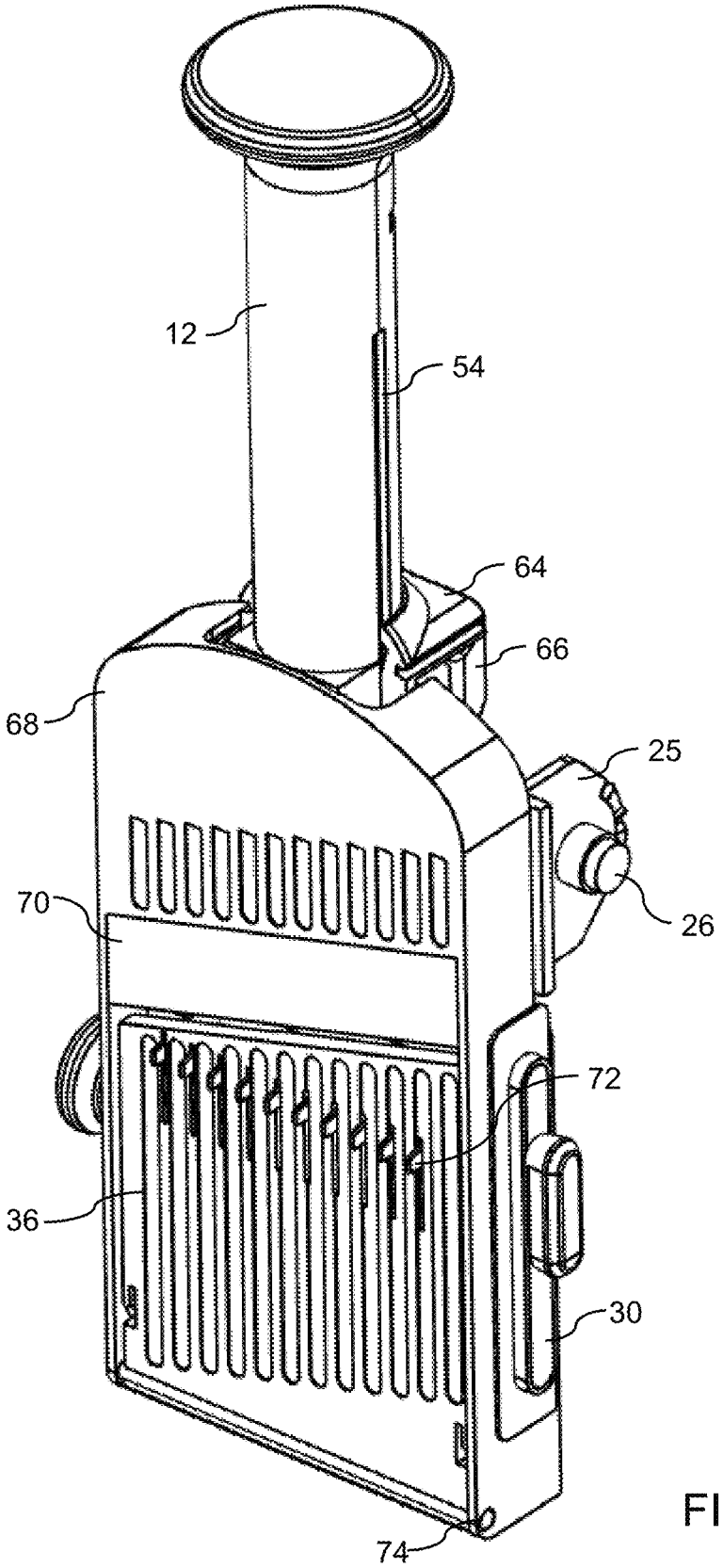
FIG. 7 is a front perspective view of a preferred carriage for a vertical slicer.

FIG. 7 illustrates the carriage 68 together with the plunger 12 which is fixedly attached to the carriage. The carriage includes a main blade 70 attached to the carriage, separated slightly from the deck 36. The deck is moveable between a position in which it lies in a common plane with the main blade and the remainder of the front surface of the carriage, and a position in which it is recessed behind the main blade and front surface of the carriage.

A pair of leg retainers, e.g. 25, are shown for reference but are not attached to the carriage 68. Rather, as seen in FIG. 5, the leg retainers 25 are attached to the frame 14 at opposing upper interior locations on the frame. In FIG. 5, one of the leg retainers is attached at a pivot location coaxial with the cavity 46, while the opposing leg retainer (mostly hidden in FIG. 5) is attached at pivot location 26. Each leg retainer thus includes a pivot location for receiving and pivotally attaching the legs to the frame, and an internal cavity for receiving a pin on the tray for storage. A leg retainer is illustrated in FIG. 7 for reference, to show the interaction of the leg retainer with the carriage 68, indicating the manner in which the leg retainers serve as a stop against further upward motion of the carriage.

The plunger 12 includes a slot formed diametrically through the plunger, in which one side 54 of the slot is visible in FIG. 7. The slot traps a portion of a plunger guide 64, as discussed further below. A lock in the form of a rocker 66 is also shown in FIG. 7, and is pivotally mounted to the plunger guide 64.

Figure 8:
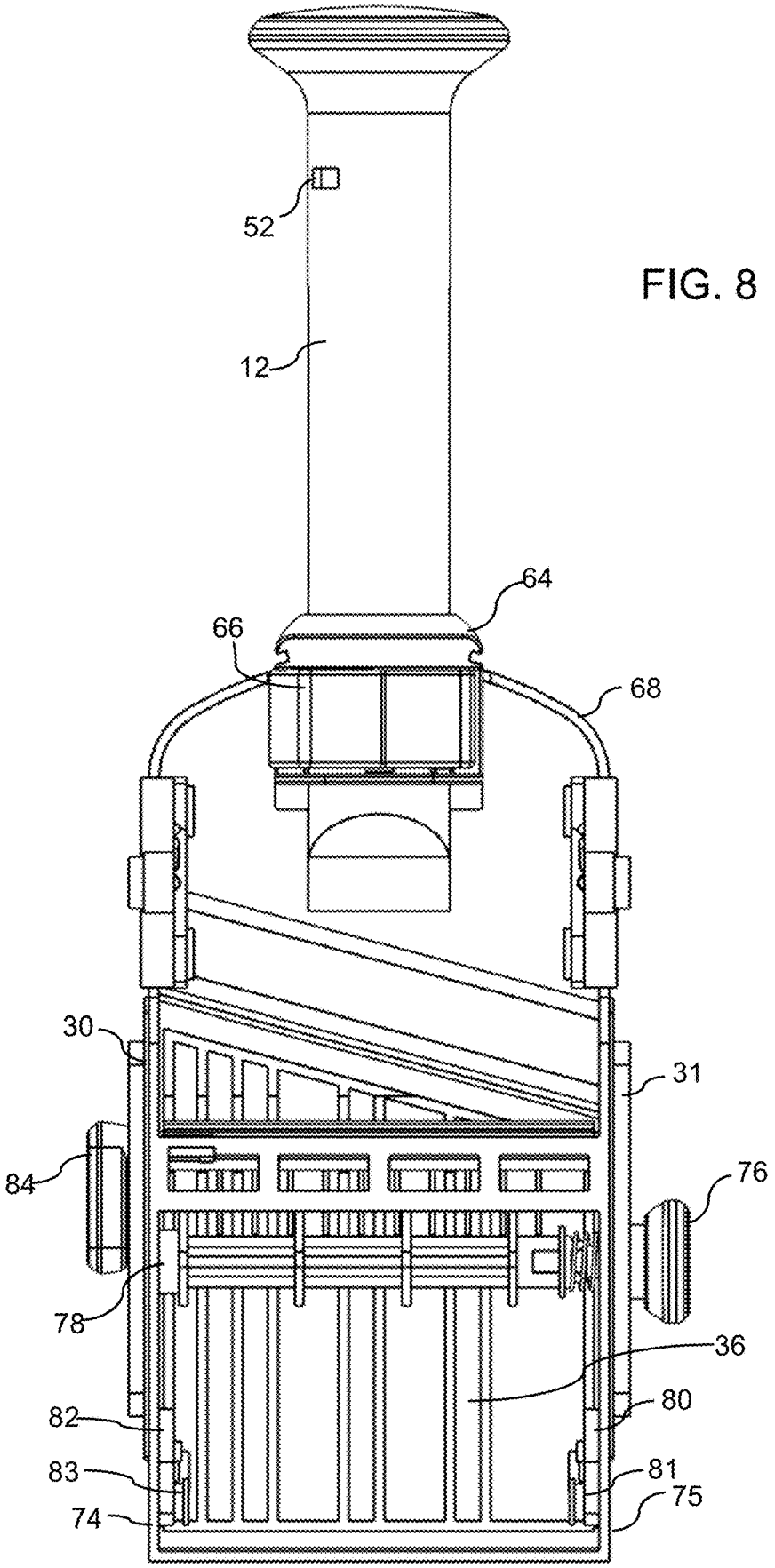
FIG. 8 is rear view of a preferred carriage for a vertical slicer.

As seen in FIG. 8, a distal end of the plunger includes a locking cavity 52 formed as a hole in the plunger. In this view, the opposing guide bars 30, 31 are visible at the outer vertical surfaces of the carriage 68. A thickness bar 78 is carried between opposing sidewalls of the carriage, terminating in one end with a selector knob 76. A julienne selector knob 84 is also shown. The deck 36 includes a pair of laterally extending pins received in holes 74, 75 formed in outer sidewalls of the carriage 68, mounting the pins within the holes to provide a pivotal attachment of the deck to the carriage. A pair of springs 80, 82 are mounted to a pair of bosses 81, 83 and configured to urge the deck in a direction toward and against the thickness bar 78.

Figure 9:
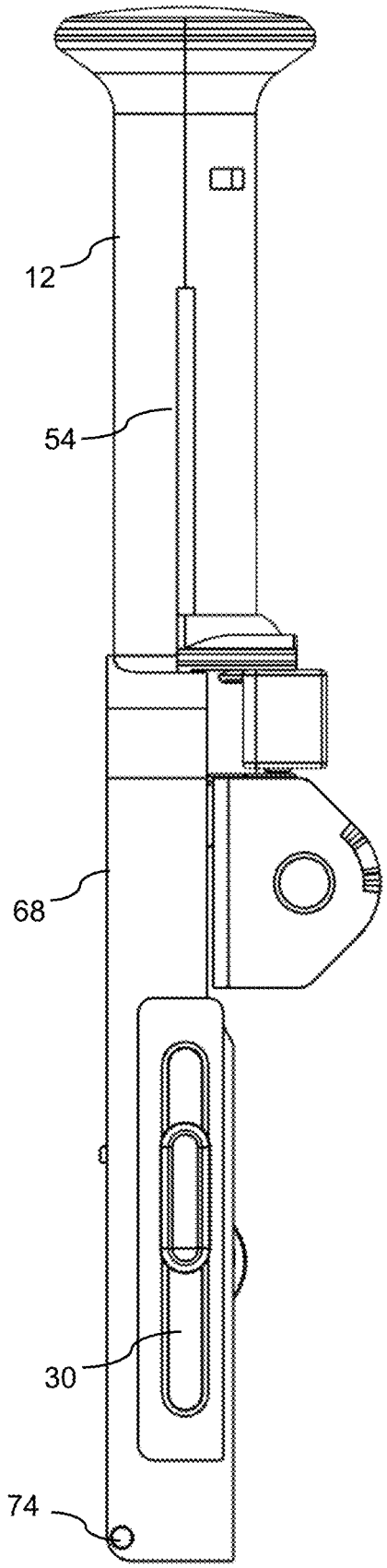
FIG. 9 is a right side view of a preferred carriage for a vertical slicer.
Figure 10:
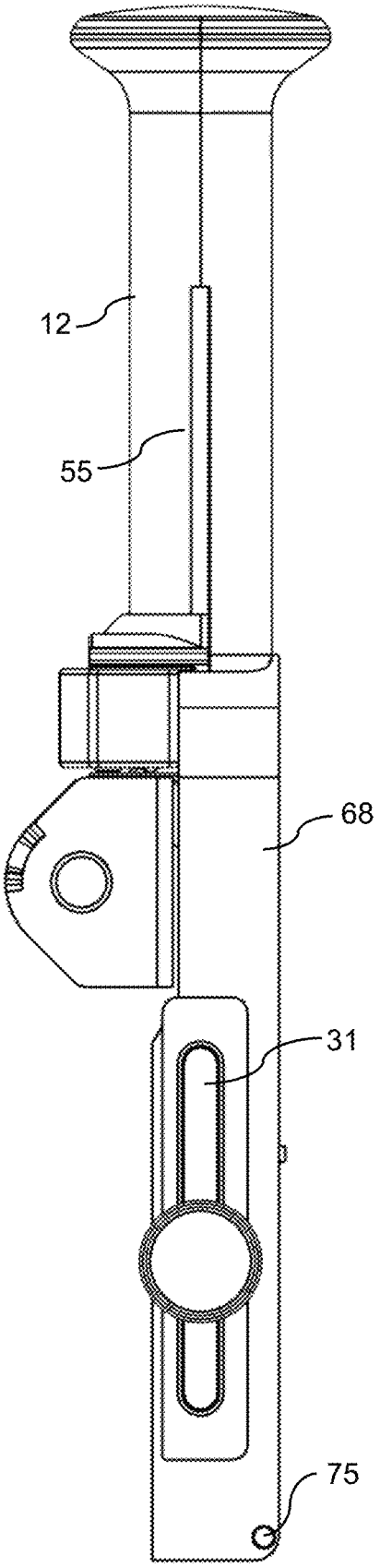
FIG. 10 is a left side view of a preferred carriage for a vertical slicer.

FIGS. 9 and 10 show the carriage including the plunger in left and right side views. In these views, the opposing sides 54, 55 of the plunger slot are visible.

Figure 11:
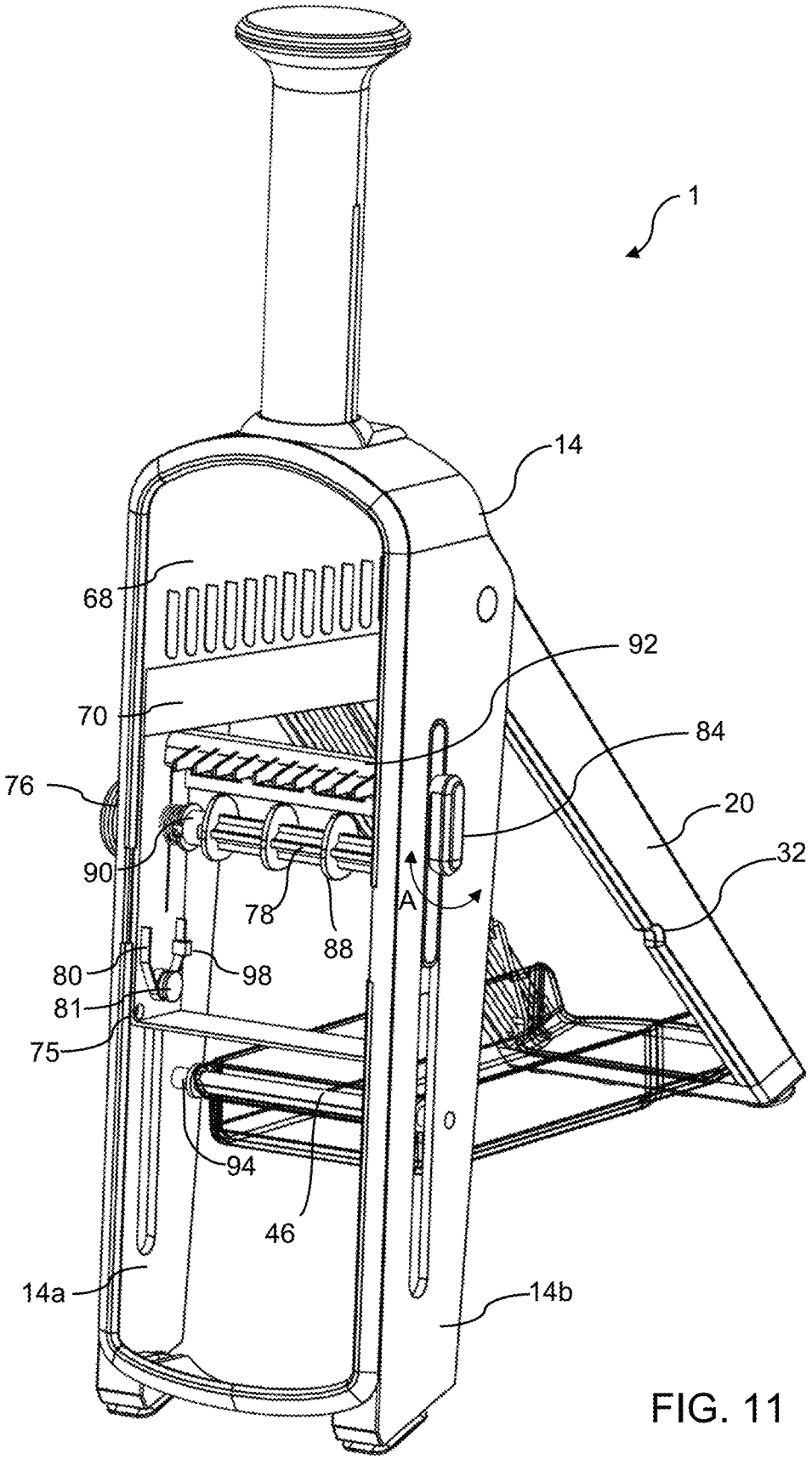
FIG. 11 is a perspective view of a preferred vertical slicer of FIG. 1, shown with certain components removed.

FIG. 11 is a perspective view of the preferred vertical slicer, shown with the face plate, deck and additional components removed for ease of illustration of certain other components. In this view, the main blade 70 is more readily visible, mounted to the carriage 68 at an upper end (that is, the plunger end), opposite the lower end (that is, the end where the pivot location 75 is located). The main blade extends across the width of the carriage, between the opposing sidewalls 14*a*, 14*b* of the carriage, preferably at a slight angle rather than being perpendicular to the axis defined by the plunger.

The thickness bar 78 is shown in FIG. 11, extending horizontally across the carriage. As shown, the thickness bar includes a plurality of eccentric cams 88 such that rotation of the thickness bar via the knob 76 causes a different portion of the cam to interact with the deck (not shown in FIG. 11). Consequently, rotation of the knob and thickness bar will cause the spring-loaded deck to move inwardly (in a direction toward the thickness bar) or outwardly (In a direction away from the thickness bar). In turn, this moves the deck into our out of a plane defined by the main slicing blade, to thereby adjust the thickness of an item being cut by the main blade.

FIG. 11 also shows the julienne selector 84, mounted to a julienne bar 92 carrying a plurality of julienne blades. In FIG. 11, the julienne blades are illustrated as being oriented in a direction toward the deck, and when the deck is in position the julienne blades will each extend through a corresponding julienne blade slot in the deck. Rotation of the julienne selector 84 in a direction indicated by arc A will rotate the julienne blades as well, thereby lowering them beneath the deck if desired by the user.

The tray pin 46 is shown in FIG. 11, supporting the tray. Opposing sides of the tray pin include a spacer 94 to position the tray slightly inward of the outer carriage sidewalls, thereby leaving a portion of the tray pin not covered by the tray. Each of the legs 20 includes a cutout 32 configured to receive a portion of the tray pin 46 at the spacer when the legs are rotated against the frame 14 for storage.

FIG. 11 further shows one of the deck springs 80 and its corresponding boss 81. An exposed end of the spring abuts the deck (not shown in FIG. 11) while an opposing end of the spring is retained in a spring clip 98 formed in the carriage.

Figure 12:
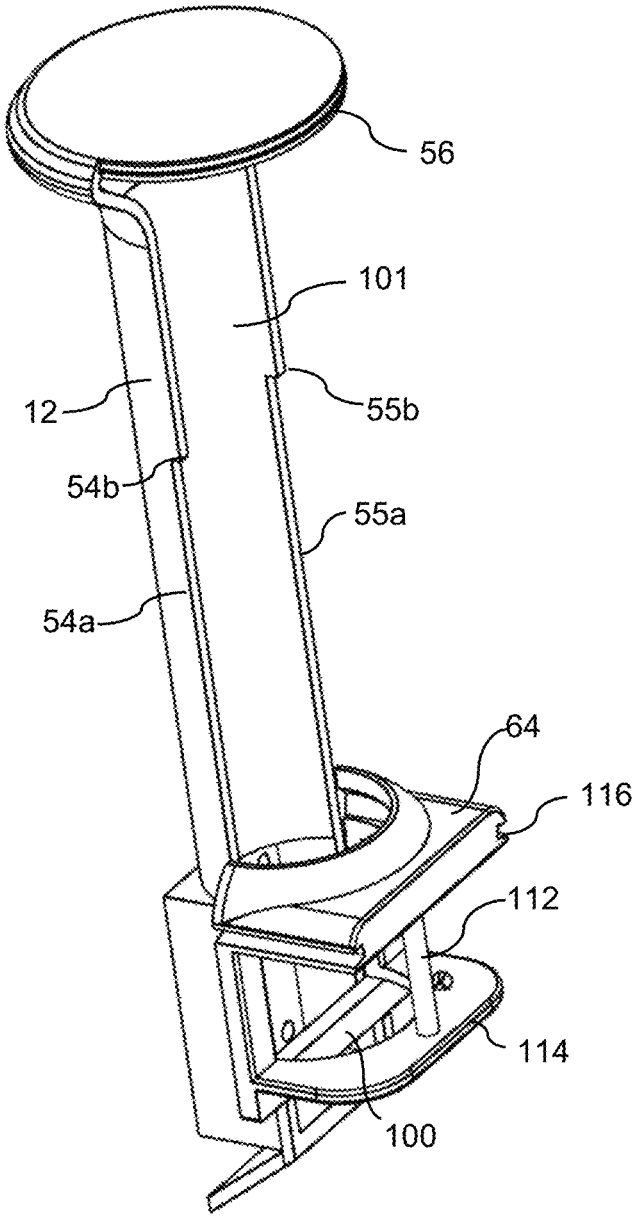
FIG. 12 is a perspective view of a portion of a plunger for use with a preferred vertical slicer.

FIG. 12 shows the plunger 12, and more particularly half of the cylindrical sidewall forming the plunger to thereby show the interior space 101 within the plunger. The plunger slot is formed by slots on opposite sides of the plunger as described above, and slot surfaces 54*a*, 55*a* are shown in this view to define the slots in the illustrated half of the plunger. At the upper end, the slots terminate at a shoulder 54*b*, 55*b*, which acts as a stop against further downward motion of the plunger and therefore the carriage.

The plunger portion in FIG. 12 is shown interacting with the plunger guide 64. One portion of the plunger guide includes a crossbar 100 extending horizontally. The crossbar is mounted within the slot formed in the plunger, thereby retaining the plunger and defining a path of travel by the length of the slot as the upper and lower ends of the slot may contact the crossbar at the extent of the opposite directions of travel, upward or downward.

A vertical axle 112 is formed on the plunger guide, preferably between an upper plate 116 and a lower plate 114. The vertical axle 112 provides a mounting location for the lock switch 66.

Figure 13:
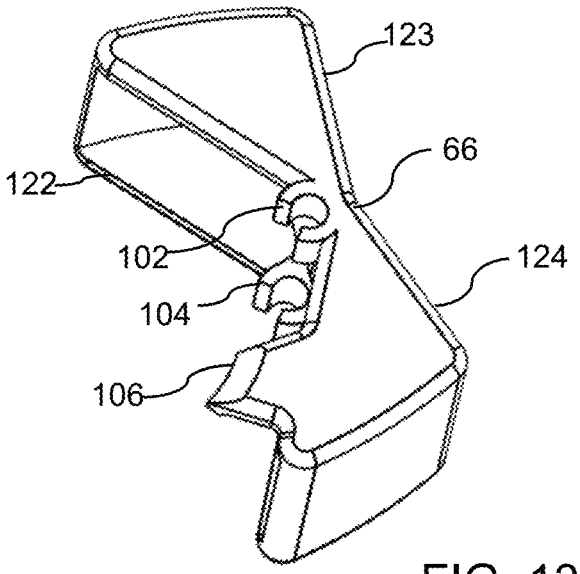
FIG. 13 is a perspective view of a preferred lock switch.

A preferred lock switch 66 is shown in FIG. 13. The lock switch preferably includes one or more clips for attachment to the vertical axle 112, and in the illustrated example it includes a pair of clips 102, 104. The clips as shown are arranged as C-clips that allow the lock switch to be removably snapped onto the vertical axle, also enabling pivotal movement of the lock switch about the axis defined by the vertical axle. One side of the lock switch includes a tab or tooth 106. When the plunger and lock switch are both mounted in the final assembly, the tab extends toward the plunger. The tab is sized and configured to be received within the locking cavity 52 formed in the plunger. Pivotal movement of the lock switch enables the tab to be selectively moved into or out of the locking cavity when the plunger is moved to a downward position, thereby aligning the tab with the location of the locking cavity. Once the tab is received within the locking cavity, the plunger is held in a downward storage position.

Figure 14:
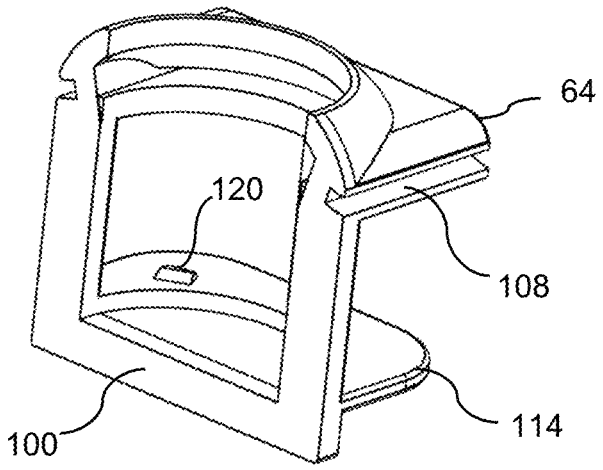
FIG. 14 is a perspective view of a preferred spring retainer.

FIG. 14 shows the plunger guide 64, including its crossbar 100. The lower plate 114 includes an abutment 120, which in this case projects upwardly from the lower plate. When the locking switch is rotated to a locking position in which the tab is inserted into the locking cavity, the abutment 120 will be positioned against an interior surface 122 of the locking switch, thereby impeding rotational movement of the locking switch and holding it in the locked position. A user may press against the opposite exterior surface 123 of the locking switch to remove the locking tab from the locking cavity. Continued pressure against the exterior surface 123 will move the locking switch to a pivotal location in which the opposite exterior surface engages the abutment 120 to thereby hold the locking switch in an unlocked position. The user therefore presses against a first side 124 of the locking switch to lock the plunger, and presses against a second side 123 of the locking switch to unlock it. In this manner, the abutment provides a frictional retention of the locking switch in either the locked or unlocked positions.

Figure 15:
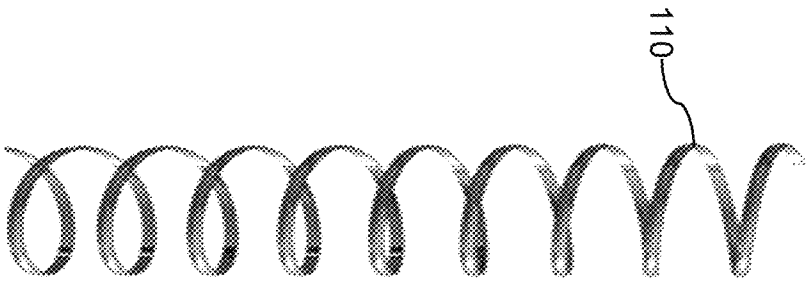
FIG. 15 is a perspective view of a preferred coil spring.

FIG. 15 illustrates an exemplary coil spring 110, separated from the vertical slicer. The coil spring is carried in the interior space 101 within the plunger, with one end contacting the crossbar 100 and the opposing end contacting the upper end of the interior of the plunger, adjacent the plunger cap 56.

Figure 16:
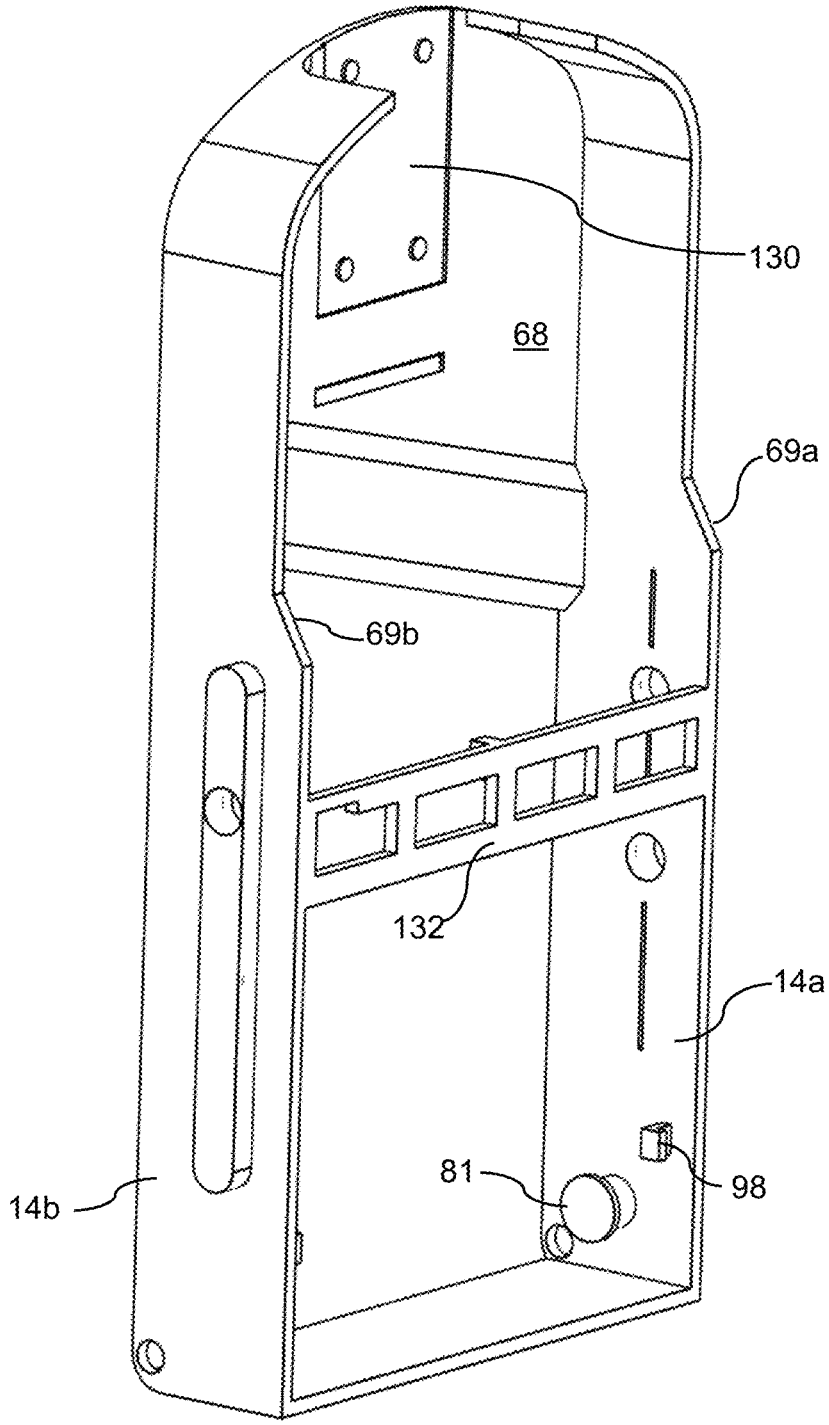
FIG. 16 is a perspective view of a preferred carriage.
Figure 17:
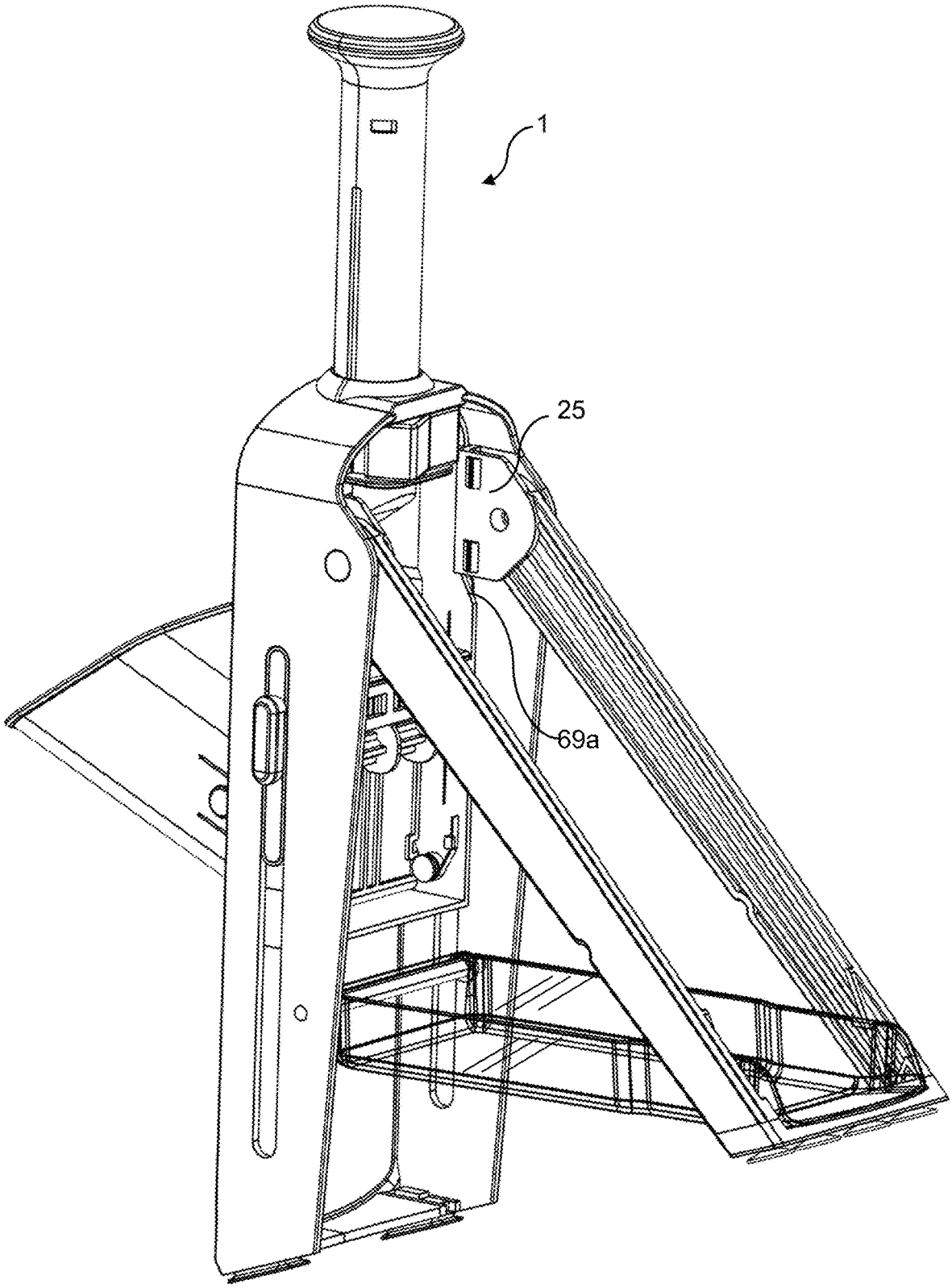
FIG. 17 is a rear perspective view of a preferred vertical slicer.

FIG. 16 illustrates the carriage 68, with the plunger and other components removed. The plunger is attached at a plunger mount 130. A crossmember 132 extends across opposing sidewalls 14*a*, 14*b* of the carriage. The carriage includes a pair of shoulders 69*a*, 69*b* formed in each of the opposing frame sidewalls, preferably as an inclined shape. As seen in FIG. 17, a leg retainer 25 will contact, or nearly contract, the corresponding shoulder (e.g. 69*a*) when the plunger is moved to its fullest upward position along its path of travel. Most preferably, the travel of the carriage is defined by the slot and its interaction with the crossbar, but it may alternatively or additionally be constrained by the abutment of the leg retainer against the carriage shoulder.

Figure 18:
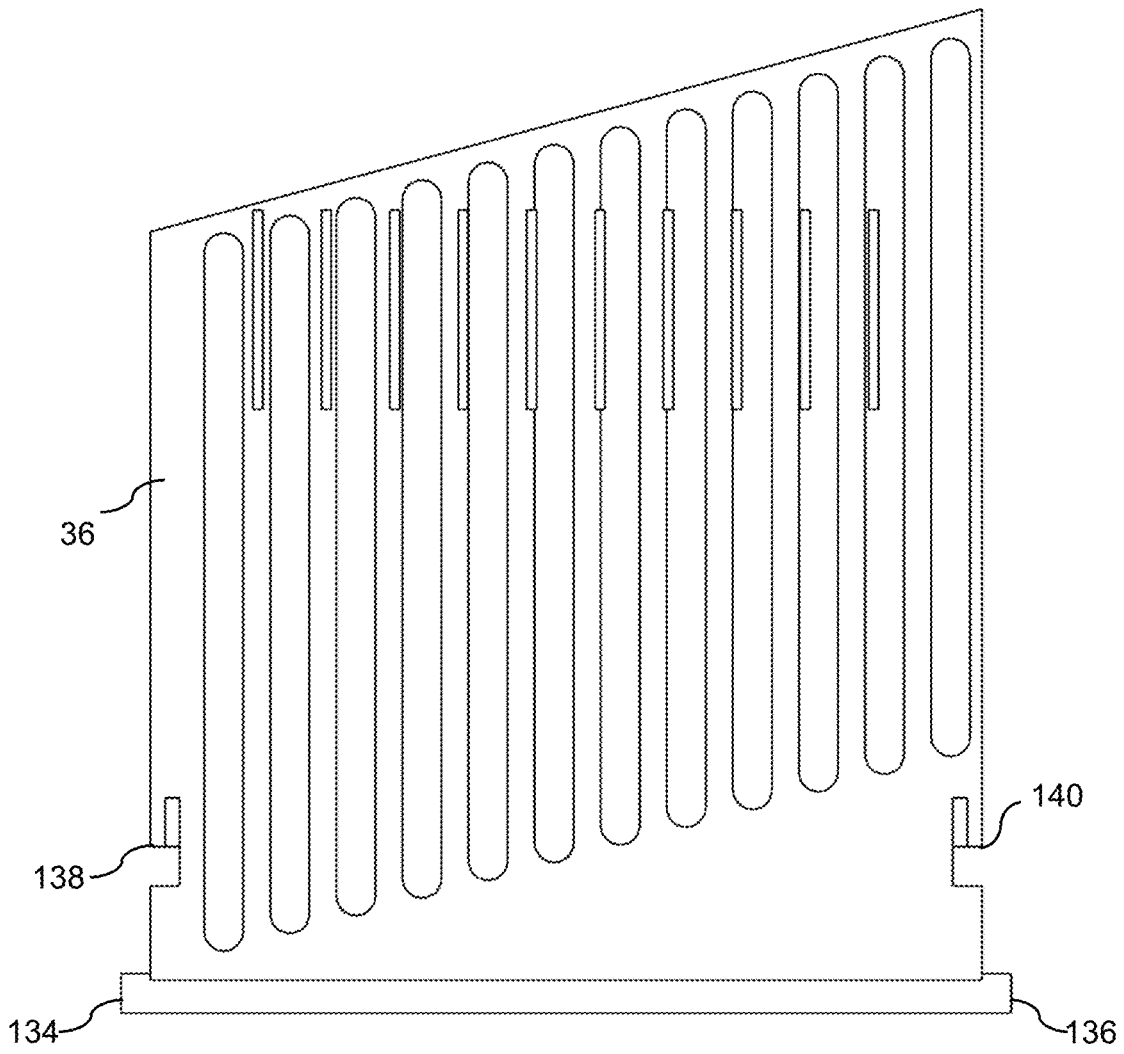
FIG. 18 is a plan view of a preferred deck for use with a carriage.

FIG. 18 shows the deck 36, including its pins 134, 136 at one end of the deck the pins being received in the holes 74, 75 of the carriage 68 as described above. A pair of spring-retaining clips 138, 140 are also indicated, for receiving and retaining the deck springs 80, 82 as described above.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims.

We claim:

1. A vertical slicer, comprising:

a frame having a lower end and an upper end, the lower end terminating in a foot, the frame having a pair of opposing frame sidewalls;

a face plate covering a front side of the frame and extending across the opposing sidewalls, the face plate further extending from the lower end to the upper end of the frame, the face plate having a central opening;

a carriage having an upper end, a lower end, and opposing carriage sidewalls extending from the upper end of the carriage to the lower end of the carriage, a deck pivotally attached to the lower end of the carriage, a main blade attached to the carriage adjacent the deck and extending between the opposing carriage sidewalls, and a plunger having a plunger cap, the plunger being fixedly attached to the upper end of the carriage, the carriage further having a pair of guide bars extending laterally outwardly from the opposing carriage sidewalls;

the frame further having a pair of carriage guide slots formed in the pair of opposing frame sidewalls, one of the pair of guide bars being received in a corresponding one of the pair of carriage guide slots, wherein the pair of carriage guide slots define a path of travel of the carriage with respect to the frame, the carriage being positioned rearward of the face plate;

a plunger guide mounted to the upper end of the frame, the plunger guide having a crossbar;

the plunger further having a plunger slot extending diametrically through the plunger, the crossbar being trained within the plunger slot and further defining a path of travel of the plunger;

a plunger spring positioned in an interior space within the plunger, the plunger spring being mounted to urge the plunger and the carriage toward an upward position in which the plunger cap is moved away from the frame; and a locking switch mounted on an axle positioned on the plunger guide, the locking switch being pivotally moveable between a locked position and an unlocked position, the locking switch having a tab extending toward the plunger, the plunger further having a locking cavity formed in an upper end of the plunger, wherein when the plunger is moved to a downward position and the locking switch is moved to the locked position, the tab is received within the locking cavity to retain the plunger and the carriage in the downward position.

2. The vertical slicer of claim 1, further comprising a pair of legs, each of the legs being pivotally attached to the frame.

3. The vertical slicer of claim 2, further comprising a tray attached to the frame via a tray pin, the tray pin extending between the opposing frame sidewalls.

4. The vertical slicer of claim 3, wherein the tray pin further comprises a pair of spacers and a pair of cutouts, the cutouts being sized and positioned to receive the pair of cutouts.

5. The vertical slicer of claim 1, wherein the plunger spring is seated on the crossbar.

6. The vertical slicer of claim 1, further comprising a hopper attached to the frame, the hopper surrounding the central opening of the face plate.

7. The vertical slicer of claim 1, wherein the plunger guide further comprises an abutment, the abutment being positioned to frictionally hold the locking switch in either the locked position or the unlocked position.

8. The vertical slicer of claim 7, wherein the plunger guide further comprises an upper plate and a lower plate, the abutment being formed on the lower plate.

9. The vertical slicer of claim 7, wherein the axle extends between the upper plate and the lower plate.

10. The vertical slicer of claim 1, further comprising a pair of legs terminating in a leg crossbar joining the pair of legs, each of the pair of legs being pivotally attached to the frame, the pair of legs each further having an upper rib and a lower rib, the upper rib and the lower rib each being positioned adjacent the leg crossbar.

11. The vertical slicer of claim 10, wherein the tray further includes a pair of opposing tray pins extending laterally outwardly, each of the opposing tray pins being received in a space defined between the upper rib and the lower rib of the pair of legs.

12. The vertical slicer of claim 11, further comprising a pair of leg retainers, the pair of legs being pivotally attached to the frame via the pair of leg retainers, the leg retainers further having a pair of cavities sized and configured to receive a respective one of the pair of opposing tray pins when the tray is pivoted to an upward storage position.

13. The vertical slicer of claim 1, wherein the carriage further comprises a crossmember extending between the opposing carriage sidewalls, a thickness bar further extending between the opposing carriage sidewalls and being pivotally moveable by a knob, the thickness bar being in contact with the deck.

* * * * *